United States Patent [19]

Lurie

[11] 3,985,050

[45] Oct. 12, 1976

[54] PIVOTED JAW PIPE WRENCH OF THE THREE-ARM LEVER TYPE

[76] Inventor: Charles L. Lurie, 738 N. Greenwood Ave., Park Ridge, Ill. 60068

[22] Filed: May 2, 1975

[21] Appl. No.: 573,913

[52] U.S. Cl. ..... 81/91 R; 81/180 B; 76/114

[51] Int. Cl.[2] ..... B25B 13/28; B21K 5/16

[58] Field of Search ..... 81/91 R, 117, 118, 180 B; 76/114, DIG. 6

[56] References Cited

UNITED STATES PATENTS

| | | | |
|---|---|---|---|
| 1,826,765 | 10/1931 | Gang | 81/91 R |
| 2,407,990 | 9/1946 | Lurie | 81/91 R |
| 2,734,414 | 2/1956 | Lurie | 81/91 R |
| 3,021,149 | 2/1962 | Griffin | 81/180 B X |
| 3,709,073 | 1/1973 | Kurtz | 76/114 X |

*Primary Examiner*—Al Lawrence Smith
*Assistant Examiner*—James G. Smith
*Attorney, Agent, or Firm*—Norman H. Gerlach

[57] ABSTRACT

A pivoted jaw pipe wrench having a three-arm lever which translates the swinging motion of the wrench handle to one of the two jaws for pipe-engaging purposes and is characterized by the fact that it is in the form of a laminated structure, thereby allowing it to be made thinner than the three-arm levers of previously designed similar wrenches but without sacrificing strength and consequent resistance to rupture. The space which is saved by the relative thinness of the three-arm lever allows a lever-reinforcing shroud on the wrench body to lie alongside of the lever for reinforcing purposes, the movable lever and its associated fixed shroud presenting a lever arrangement which substantially equals the transverse width of conventional one-piece cast three-arm levers for the same purpose. Ancillary features of novelty which are associated with the wrench include the provision of a pair of reaction lugs, one on the three-arm lever and one on the wrench body, such lugs replacing the separately-fashioned reaction members for the opposite ends of lever-biasing springs which are used with similar wrenches.

5 Claims, 7 Drawing Figures

PIVOTED JAW PIPE WRENCH OF THE THREE-ARM LEVER TYPE

The present invention relates generally to pipe wrenches of the type which is used by plumbers for tightening or loosening a pipe or the like from its joint with another pipe, or for preventing turning of a pipe while a cap or other fitting is applied thereto or removed therefrom. More particularly, the invention is concerned with a pipe wrench like that which is shown and described in U.S. Pat. No. 2,734,414, granted on Feb. 14, 1956 and entitled "PIVOTED-JAW PIPE WRENCH HAVING A JAW-ACTUATING SPRING," and the principal object of the present invention is to provide a pipe wrench which is, for several reasons, an improvement over the wrench of such patent.

In general, the pipe wrench of the aforementioned patent consists of a wrench body which has integrally formed thereon a forwardly projecting, fixed, jaw arm. A movable jaw arm projects forwardly from the wrench body and opposes the fixed jaw arm, both arms being provided on their outer or distal ends with pivoted, pipe-engaging, tooth-equipped, block-like jaw elements. A turnbuckle-type connection extends between the fixed and movable jaw arms, has a pivotal connection with both arms, and is used to adjust the working distance between the two pivoted, pipe-engaging tooth-equipped, jaw elements. An elongated, torque-applying, pivoted, lever-like handle projects rearwardly from the wrench body and cooperates with one arm of a spring-biased, three-arm lever which is wholly enclosed within the wrench body. A second arm on the three-arm lever is pivoted to the body, while the third arm of such lever is pivotally connected to the movable jaw arm. In the operation of the wrench, after the turnbuckle connection has been adjusted for the size of pipe to be seized and the pivoted jaw elements caused to straddle the pipe, initial swinging movement of the torque-applying handle in one direction rotates the three-arm lever in such a manner that the movable jaw arm is shifted forwardly and also caused to pivot inwardly a slight distance so as firmly to grasp the pipe between the two jaw elements with progressively increasing force and further swinging movement of the operating handle applies the desired degree of torque or counter-torque to the pipe to which the wrench is applied.

Whereas the pipe wrench of aforementioned U.S. Pat. No. 2,734,414 has proven quite satisfactory and offers numerous advantages over the widely used Stillson-type wrenches, it nevertheless is possessed of certain limitations which have been obviated by the present invention. These limitations are mainly concerned with the construction of the aforementioned three-arm lever which assimilates substantially all of the reaction force of the two jaw elements on the outer or distal end portions of the jaw arms when they seize and rotate the pipe, and, therefore, is under tremendous stress when the wrench is in use. In particular, the aforementioned third arm of such lever which is pivoted to the movable jaw arm is subjected to the most stress so that, after a long period of use of the wrench, wear takes place, lost motion occurs, and ultimately there is danger of such arm becoming ruptured, this despite the fact that it has been considered necessary to construct such three-arm lever in the form of a relatively thick sturdy casting with a wide base web between such third arm and the remainder of the lever.

The present invention is designed to overcome the above-noted limitation that is attendant upon the construction and use of such a three-arm lever and, toward this end, the invention contemplates that such lever be made of multiple layers or laminations of plate metal which may inexpensively be formed by a simple stamping operation in a punch press, the laminations being held together by roll pins. The advantage of a laminated structure, strengthwise, over a similar cast structure is well known, but in the present instance, by using laminations, the same strength may be attained with a considerably thinner three-arm lever, the difference in thickness being sufficient to allow for the creation of a shroud on the body of the tool, the shroud closely fitting against such third arm and protecting it against lateral bending or twisting. The use of such a shroud in connection with the cast three-arm lever of the earlier pipe wrench would, of course, be impractical because it would reduce the thickness of the three-arm lever to such an extent that the third arm would be totally inadequate to resist the stresses which are applied thereto when the wrench is in use.

A further limitation that is attendant upon the construction and use of the three-arm lever of the earlier pipe wrench resides in the relatively great cost of constructing such lever. Because this lever is spring-biased to a retracted position, it has been considered necessary to fashion a separate angle bracket which serves as a reaction seating lug for one end of the biasing spring and to secure such angle bracket in position on the cast three-arm lever by means of a fastening screw. According to the present invention, the laminations which cooperate to make up the three-arm lever are so stamped as to provide a composite spring-seating lug on the finished lever, thus obviating the necessity of fashioning and using a separate bracket to produce a seating lug for the spring and also eliminating the step of affixing such bracket in place on the three-arm lever.

Another limitation that is attendant upon the design and construction of the earlier patented wrench resides in the use of a one-piece case-hardened jaw element at the outer end of the aforementioned movable jaw arm, the cost of producing such a jaw element being relatively high. According to the present invention, the corresponding jaw element at the outer end of the movable jaw arm is of a composite nature and embodies a pair of stamped side plates, to which there is suitably pinned a case-hardened jaw face proper, while furthermore such jaw face is shrouded for reinforcement purposes.

The provision of a pipe wrench having a laminated and specially-shaped three-arm lever, as well as a reinforced upper jaw element such as has briefly been outlined above, constitutes the principal object of the present invention.

A further object of the invention resides in the provision of a novel counterpart seating lug on the wrench body, such counterpart lug cooperating with the seating lug on the three-arm lever for spring-retention purposes. The counterpart lug on the wrench body takes the place of a formerly employed seating pin, the positioning of which required the drilling of aligned holes in the wrench body.

A still further object of the invention is to provide a pipe wrench which is generally of new and improved construction and is characterized by high efficiency, durability, and low cost of manufacture.

Other objects and advantages of the invention, not at this time enumerated, will readily suggest themselves as the nature of the invention is better understood from a consideration of the following detailed description.

The invention consists in the several novel features which are hereinafter described and are more particularly defined by the claims at the conclusion hereof.

In the accompanying single sheet of drawings forming a part of this specification, one illustrative embodiment of the invention is shown.

In these drawings:

FIG. 1 is a side elevational view of a pipe wrench embodying the principles of the present invention and showing the improved wrench in the position which it assumes directly after application of the pivoted jaw elements on the outer ends of the jaw arms of the wrench to a pipe which is to be seized for turning or reaction purposes, but prior to application of downward force on the outer end of the lever-type handle;

Figures 1, 2, 3, 4, 5, 6, 7:
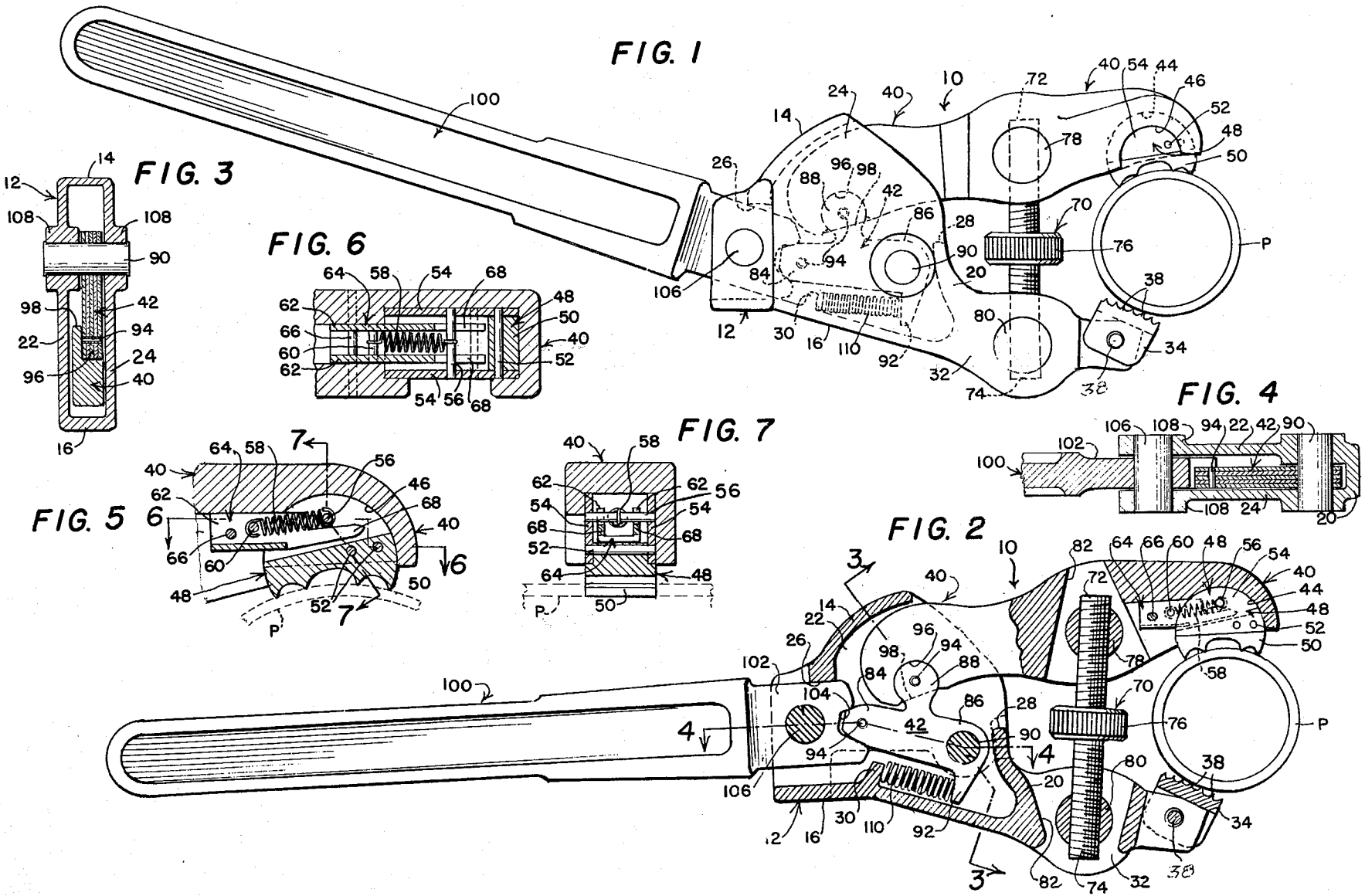
FIG. 2 is a side elevational view similar to FIG. 1 but showing the wrench in its operative, pipe-seizing relationship, portions of the jaw arms and the body being broken away and shown in section in the interests of clarity.
FIG. 3 is a transverse sectional view taken substantially on the line 3—3 of FIG. 2.
FIG. 4 is a longitudinal sectional view taken substantially on the line 4—4 of FIG 2.
FIG. 5 is an enlarged fragmentary detail view of the outer end region of the movable jaw arm which is shown in FIG. 2 and illustrating the manner in which the composite, pivoted jaw element on the outer or distal end of such jaw arm is spring-biased.
FIG. 6 is a longitudinal sectional view taken substantially on the line 6—6 of FIG. 5.
FIG. 7 is a transverse sectional view taken substantially on the line 7—7 of FIG. 5.

Referring now to the drawings in detail and in particular to FIGS. 1 and 2, a pipe wrench embodying the present invention is designated in its entirety by the reference numeral 10. Such wrench comprises, in addition to other hereinafter described parts, a central cast metal body 12 which is of somewhat irregular configuration, is generally flat, and embodies a narrow, forwardly and upwardly inclined top wall 14, a narrow bottom wall 16, a narrow open, slot-like rear end 18, a narrow, upstanding front wall 20, and side walls 22 and 24 (see FIG. 3). The space between the rear end of the top wall 14 and the upper end of the front wall 20 is open, thus forming or providing a narrow slot 26 on the wrench body 12. Similarly, the space between the forward end of the top wall 14 and the upper end of the front wall 20 is open, thus providing a narrow slot 28. An upstanding web 30, which is formed as an integral part of the bottom wall 16, affords a spring seat in a manner and for a purpose that will be made clear presently.

Considering the wrench 10 in the oriented position in which it is shown in FIGS. 1 and 2 of the drawings, the lower region of the wrench body 12 is formed with an integral forwardly extending fixed jaw arm 32, the extreme forward or outer end of which carries a lower jaw element 34. The latter consists of an upper bight portion and also depending side portions in straddled relation with the outer end of the jaw arm 32, and is pivoted by means of a horizontal pin 36 in order that it may rock to a limited extent back and forth with respect to the jaw arm 32. As shown in FIG. 2, the pin 36 extends through aligned holes in the outer end of the jaw arm 32 and the side portions of the jaw element 34. Also as shown in FIG. 2, the hole in the outer end of the jaw arm 32 is of greater diameter than the pivot pin 36 and the upper outer corner part of said jaw arm 32 is chamfered to the end that the upper face of the jaw arm 32 is V-shaped in a lengthwise fashion, the V being of extremely small slant angle. As the result of the aforementioned chamfer and the use of the oversized hole in the jaw element 34, the lower jaw element 34 is free to rock to a limited extent and this materially increases the capabilities of use of the wrench as a whole. A series of teeth 38 is formed on the upper surface of the bight portion of the jaw element 34, and it is arranged on a slightly curved arcuate bias.

Still referring to FIGS. 1 and 2, an elongated upper jaw arm 40 has its inner end region slidably confined between the two side walls 22 and 24 of the wrench body 12 and is capable of a slight forward shifting motion relatively to the wrench body, as well as of a very slight inward rocking motion so that its forward or outer end may move toward and away from the jaw element 34 on the fixed jaw arm 32. The fore and aft movements of the movable upper jaw arm 40 are effected under the control of a laminated, spider-like, three-arm lever 42 which constitutes one of the principal features of the present invention and will be described in detail subsequently.

The outer end of the movable jaw arm 40 has formed therein an inside semi-cylindrical recess 44 therein, one wall of the recess being relieved as indicated at 46 and the other wall being a full wall and constituting a shroud for a composite second or upper jaw element 48 (see FIGS. 1, 2, 5, 6 and 7) which is spring-biased and nested within the recess 46. This second or upper jaw element embodies a case-hardened, tooth-equipped, jaw block 50 which by means of a pair of transversely extending pints 52 carries a pair of semi-circular side plates 54 (see FIG. 6). Said side plates project upwardly from the jaw block 50 so that the composite upper jaw element 48, in effect, is generally U-shaped in cross section. An anchor pin 56 extends transversely between the two side plates 54 and establishes an eccentrically-disposed anchor point for one end of a tension-type biasing spring 58. The other end of the spring 58 is secured to a second anchor pin 60 which extends across the side flanges 62 of a limit stop bracket 64 which is U-shaped in cross section and, in addition, is pivotally connected to the side walls 22 and 24 of the wrench body 12 by a transversely extending pin 66 (see FIGS. 5 and 6). The side flanges 62 of the limit stop bracket 64 are formed with relatively long, forwardly extending, narrow abutment arms 68 which project beneath the spring anchor pin 56 as shown in FIG. 5. The spring 58, being eccentrically anchored to the composite jaw element 48, normally applies torque to such element tending to rotate the same in a counterclockwise direction as viewed in FIGS. 1 and 2, the extent of such rotation being limited by the arms 68 at such time as these arms engage the upper face of the case-hardened jaw block 50. Such engagement of the arms 68 and the jaw block 50 takes place when the wrench 10 is in its free or pipe-releasing condition.

Referring again to FIGS. 1 and 2, the movable jaw arm 40 is regulably adjustable toward and away from the fixed jaw arm 32 to condition the wrench as a whole for application to pipes or other objects of different diameters. Accordingly, a generally vertical, turnbuckle-type, adjusting screw 70 extends between the two jaw arms 32 and 40 and is provided with an upper shank 72 having a left-hand screw thread and a lower shank 74 having a right-hand screw thread. A medial manual adjusting knob 76 having a knurled periphery is formed on the adjusting screw 70 between the adjacent ends of the two aforementioned shanks. The shanks 72 and 74 are threadedly received through a pair of transversely extending pivot pins 78 and 80 which are rotatably carried in the medial regions of the jaw arms 40 and 32, respectively, suitable clearance or relief areas 82 being formed in both jaw arms to accommodate reception of the shanks 72 and 74.

Still referring to FIGS. 1 and 2, and additionally to FIGS. 3 and 4, the aforementioned laminated three-arm lever 42 is of inverted T-shaped configuration or design as viewed in FIG. 2 and is provided with a first rearwardly extending lever arm 84, a second forwardly extending arm 86, and a third lateral and upwardly extending arm 88. The outer end region of the second arm 86 is pivotally secured to the wrench casting 12 by means of a relatively sturdy, transversely extending, pivot pin 90. As previously stated, the lever 42 is of laminated construction, five such laminations being disclosed in FIGS. 3 and 4 although a greater or lesser number of such laminations may be employed if desired. By forming the lever 42 of a plurality of stamped plate metal laminations, the lever as a whole is capable of being produced at the lowest possible cost and, in addition, it possesses maximum strength while having minimum thickness. The forward or outer end of the lever arm 86 of the lever 42 is provided with an integral, downwardly extending lug 92 which serves a purpose that will be made clear presently. The various laminations of the lever 42 are stamped from plate metal and are held together by means of a pair of transversely extending roll pins 94.

The rear end region of the movable jaw arm 40 is formed with an open-sided, semi-cylindrical, socket-like recess 96 which receives therein the bulbous third lever arm 88 with a snug but rotatable fit. Thus, it will be observed that when the lever 42 is rotated in a clockwise direction as viewed in FIG. 2 about the axis of the pivot pin 90, the third lever arm 88 will tend to shift the entire movable jaw arm 40 in a forward direction.

It is to be noted at this point that because the aforementioned socket-like recess 96 in the rear end region of the movable lever arm 40 does not extend completely through such arm, a web or shroud 98 which appears in full lines in FIG. 3 and in dotted lines in FIGS. 1 and 2 overhangs the third arm 88 of the lever 42 in close-fitting relationship with respect thereto. The provision of this shroud is made possible by reason of the fact that the laminated three-arm lever 42 is somewhat of less thickness than the distance between the side walls 22 and 24 of the wrench body 12. By providing the shroud 98 which, as previously pointed out, overhangs the third arm of the lever 42 in close-fitting relationship, the three-arm lever 42 is effectively and efficiently held against lateral displacement within the wrench body 12 and is precluded from twisting with respect to its point of articulation which is formed by the pivot pin 90.

As best seen in FIG. 2 of the drawings, an elongated manipulating lever-like handle 100 is provided with a reduced or flattened forward end region 102 which projects a slight distance into the aforementioned slot 26 in the hollow wrench body 12 and is formed with a notch-like recess 104 into which the extreme rear or outer end portion of the first lever arm 84 projects. The flattened end region 102 of the wrench handle 100 is pivoted by a relatively sturdy, transversely extending, pivot pin 106 to the wrench body 12, such pin extending between the two side walls 22 and 24, suitable external bosses 108 (see FIGS. 3 and 4) being provided on the side walls for pivot pin-reinforcing purposes.

The aforementioned downwardly extending seating lug 92 on the laminated three-arm lever 42 and the aforementioned upstanding web 30 on the bottom wall 16 of the wrench body 12 have interposed therebetween a helical compression spring 110, the function of which is yieldingly to bias the lever 42 in a counterclockwise direction as viewed in FIG. 2, thereby tending to maintain the operating handle 100 in the raised position in which it is shown in FIG. 1 by reason of the fact that the bottom edge of the lever arm 84 bears against the lower side wall of the notch-like recess 104. In this raised position of the operating handle 100, the third arm 88 of the three-arm lever 42 serves to maintain the movable jaw arm 40 in a rearmost position wherein the two pivoted jaw elements 34 and 48 assume their wide open positions commensurate with the adjustment of the turnbuckle-type adjusting screw 70.

In the operation of the herein described pipe wrench 10, when it is desired to turn a pipe P of given diameter, the knurled adjusting knob 76 of the turnbuckle-type adjusting screw 70 is initially rotated in the proper direction to position the jaw elements 34 and 48 on the outer or distal ends of the jaw arms 32 and 40 so as to receive the pipe therebetween. This adjustment should be made so as to cause the upper jaw element 48 to rotate in a clockwise direction as viewed in FIG. 1 against the action of the spring 58 (see FIGS. 2 and 6) throughout a small degree inasmuch as the left corner of the case-hardened jaw block 50 will initially engage the pipe so that it is necessary to force the two jaw elements forwardly and onto the pipe, whereupon the tooth-equipped portion of the jaw block of the upper jaw element 48 will then seat squarely on the circumference of the pipe as shown in FIG. 1. Immediately after the two jaw elements have thus engaged the pipe, the operating handle 100 is swung downwardly from the position in which it is shown in FIG. 1 to the position of FIG. 2. This movement of the wrench handle 100 exerts a camming action between one wall of the notch-like recess 104 and the first lever arm 84 of the three-arm lever 42, thereby causing the latter to swing in a clockwise direction as viewed in FIG. 2. In connection with such swinging of the lever 42, the third lever arm 88 shifts forwardly a slight distance and carries the entire movable jaw arm 40 forwardly, while at the same time such arm pivots slightly by reason of the pivot pin 78 and in such a manner as to move the jaw element 48 inwardly toward the jaw element 34. The pipe P is thus firmly gripped by the two jaw elements 34 and 48, and further downward movement of the handle 100 exerts a powerful torque-applying force on the pipe P.

If a single downward stroke of the operating handle 100 is not sufficient to effect the desired pipe-tightening operation and it is necessary that additional pipe-turning operations be resorted to, the operating handle 100 may be restored to its retracted position without withdrawing the jaw members from the pipe P and then given another downward stroke. During such retraction of the handle 100, a forward thrust on the same will maintain the jaw elements 34 and 48 in their straddling relationship with respect to the pipe although the inward gripping pressure will be relieved due to a reverse camming of the three-arm lever 42 by the reduced portion 102 of the handle 100. As the handle is subsequently moved downwardly to perform its second stroke, the previously described pipe-seizing and turning operation will be repeated.

After the pipe P has been tightened to the desired degree, a reverse stroke of the handle as previously described will release the pressure of the jaw elements 34 and 48 and, thereafter, a rearward pull on the handle 100 will slide or slip said jaw elements from the pipe. It is obvious that if the pipe P is to be turned in a clockwise direction as viewed in FIG. 1, it is merely necessary to invert the pipe wrench or otherwise reverse its position.

The invention is not to be limited to the exact arrangement of parts shown in the accompanying drawings or described in this specification as various changes in the details of construction may be resorted to without departing from the spirit or scope of the invention. Therefore, only insofar as the invention is particularly pointed out in the accompanying claims is the same to be limited.

I claim:

1. In a pipe wrench having a generally flat, hollow, narrow body provided with slot-like open front and rear ends, a fixed jaw arm projecting forwardly from said body and carrying a pivoted, tooth-equipped, jaw element at its outer end, a second and movable jaw arm disposed in opposed and spaced relation with the fixed jaw arm, having its inner end region projecting into said wrench body through the slot-like open front end thereof, and carrying a pivoted, tooth-equipped, jaw element at its outer end, said second and movable jaw arm being capable of limited longitudinal sliding movement through said open front end, a turnbuckle-type adjusting screw extending between the medial portions of said jaw arms, pivotally connected to the latter, and adapted upon manipulation thereof to effect movement of the second and movable jaw arm toward and away from the fixed jaw arm in order to regulate the pipe-receiving distance between said pivoted jaw elements, and an operating wrench handle having its forward end projecting into said wrench body through the slot-like open rear end of the latter and pivotally connected to said body at a point inwardly of said rear end, the improvement which comprises a relatively thin, spider-like, three-arm lever of laminated plate construction, disposed within the central region of the body, and having a forwardly projecting lever arm connected pivotally to the body, a rearwardly projecting lever arm designed for camming engagement with the forward end of said wrench handle, and a lateral lever arm pivotally connected to the inner end region of said second and movable jaw arm, the pivotal connection between said lateral lever arm and the movable jaw arm comprising a semi-cylindrical open sided socket which is formed in the inner end region of said second and movable jaw arm, said socket having a single side wall which overhangs the adjacent side portion of the lateral lever arm in close fitting relationship and thus establishes a protective reinforcing shroud for such lever arm, said lateral lever arm being responsive to swinging movement of the wrench handle in one direction to slide the second and movable jaw arm forwardly through the slot-like open front end of the body and also effect tilting of such slidable jaw arm in a direction to move the tooth-equipped jaw elements toward each other into pipe-gripping relationship, said three-arm lever having associated with it spring means disposed within the body and positioned between the said three-arm lever and the body and effective to urge the former in a direction yieldingly to bias the wrench handle for reverse swinging movement.

2. In a pipe wrench, the improvement set forth in claim 1 and wherein said spring means comprises a compression spring having one end thereof seating upon an internal lug which is formed on the wrench body and a lateral seating lug which is provided on the laminated three-arm lever as integral portions of the lever laminations.

3. In a pipe wrench, the improvement set forth in claim 1 together with the additional improvement wherein the pivoted tooth-equipped jaw element at the outer end of the second and slidable jaw arm is of a composite nature and embodies a case-hardened jaw block provided with pipe-gripping teeth thereon, and a pair of upstanding side flanges secured to the opposite sides of such jaw block, an anchor pin projecting across said side plates, a limit stop bracket pivoted at its rear end to the wrench body and having forwardly extending abutment arms projecting between said anchor pin and the jaw block proper, a second anchor pin on said limit stop bracket, and a tension spring connected between said anchor pins and serving rotationally and yeildingly to bias the composite, tooth-equipped jaw element into tooth-seating relationship upon a pipe undergoing turning movement by the pipe wrench.

4. In a pipe wrench, the improvements set forth in claim 3 and wherein said case-hardened jaw block is formed with a pair of lateral recesses on opposite sides thereof for reception of the lower edges of said upstanding side plates, and the side plates are secured in position on the case-hardened jaw block by roll pins.

5. In a pipe wrench having a generally flat, hollow, narrow body provided with a slot-like open front and rear ends, a fixed jaw arm projecting forwardly from said body and carrying a pivoted, tooth-equipped jaw element at its outer end, a second and movable jaw arm disposed in opposed and spaced relation with the fixed jaw arm, having its inner end region projecting into the body through the slot-like open front end thereof, and carrying a pivoted, tooth-equipped jaw element at its outer end, said second jaw arm being capable of limited longitudinal sliding movement through said open front end, a turnbuckle-type adjusting screw extending between the medial portions of said jaw arms, pivotally connected to the latter, and adapted upon manipulation thereof to effect movement of the second and movable jaw arm toward and away from the fixed jaw arm in order to regulate the pipe-receiving distance between said jaw elements, an operating wrench handle having its forward end projecting into said wrench body through ther slot-like open rear end of the latter and pivotally connected to the body at a point inwardly of its rear end, and a spider-like three-arm lever disposed within said wrench body and having a first lever arm pivoted to the body, a second lever arm designed for camming engagement with the forward end of the wrench handle, and a third and lateral lever arm pivoted to the inner end region of the second and movable jaw arm, the improvement which comprises having the pivoted jaw element at the outer end of the second and movable jaw arm be of a composite nature and embody a case-hardened jaw block provided with pipe-gripping teeth thereon, and a pair of upstanding side plates secured to the opposite sides of such jaw block by roll pins, said case-hardened jaw block being formed with a pair of lateral recesses on opposite sides thereof for reception of the lower edges of said upstanding side plates, and providing the wrench additionally with an anchor pin projecting across said side plates, a limit stop bracket pivoted at its rear end to the wrench body and having forwardly extending abutment arms projecting between said anchor pin and the jaw block, a second anchor pin on said limit stop bracket, and a tension spring connected between said anchor pins and serving rotationally and yieldingly to bias the composite tooth-equipped jaw element into tooth-seating relationship upon a pipe undergoing turning movement by said pipe wrench, said lateral lever arm of the three-arm lever being responsive to swinging movement of the wrench handle in one direction to shift the second and movable jaw arm forwardly through the slot-like open front end of the wrench body and also to effect tilting of such slidable jaw arm in a direction to move the tooth-equipped jaw elements toward each other in pipe-gripping relationship, said three-arm lever having associated with its spring means disposed within said wrench body, positioned between the spider-like three-arm lever and the wrench body and effective to urge the former in a direction yieldingly to bias the wrench handle for reverse swinging movement.

* * * * *